United States Patent [19]

Brinkhoff et al.

[11] Patent Number: 4,697,299

[45] Date of Patent: Oct. 6, 1987

[54] VACUUM CLEANER HAVING A VACUUM HOSE HOLDER

[75] Inventors: Helmut Brinkhoff, Werther; Gunter Gloning; Heinz-Gunter Steinkotter, both of Bielefeld, all of Fed. Rep. of Germany

[73] Assignee: Miele & Cie. GmbH & Co., Gutersloh, Fed. Rep. of Germany

[21] Appl. No.: 923,664

[22] Filed: Oct. 27, 1986

[30] Foreign Application Priority Data

Oct. 25, 1985 [DE] Fed. Rep. of Germany ..... 3537936

[51] Int. Cl.[4] ..... A47L 9/00

[52] U.S. Cl. ..... 15/323; 15/327 F; 15/339

[58] Field of Search ..... 15/327 C, 339, 323, 15/327 F

[56] References Cited

U.S. PATENT DOCUMENTS

| | | | |
|---|---|---|---|
| 2,046,684 | 7/1936 | Hoover | 15/323 X |
| 2,232,548 | 2/1941 | McAnerney | 15/323 |
| 2,570,346 | 10/1951 | Hoover | 15/327 F |
| 2,603,351 | 7/1952 | Vedder | 15/323 X |
| 2,634,451 | 4/1953 | Dow | 15/327 F |
| 2,850,756 | 9/1958 | Ziegler et al. | 15/327 C X |
| 3,509,590 | 5/1970 | Koshiyama | 15/327 F X |
| 4,426,857 | 1/1984 | Epstein | 15/323 X |
| 4,472,855 | 9/1984 | Murphy et al. | 15/339 X |
| 4,563,789 | 1/1986 | Berfield | 15/339 X |

FOREIGN PATENT DOCUMENTS

| | | | |
|---|---|---|---|
| 464480 | 8/1928 | Fed. Rep. of Germany | 15/327 F |
| 3044976 | 6/1982 | Fed. Rep. of Germany | 15/399 |
| 631187 | 9/1927 | France | 15/323 |
| 895125 | 3/1944 | France | 15/323 |

*Primary Examiner*—Chris K. Moore

*Attorney, Agent, or Firm*—Collard, Roe & Galgano

[57] ABSTRACT

There is provided a vacuum cleaner, particularly a floor vacuum cleaner with a rack or holder for the vacuum hose pipe, the rack is a two-part unit consisting of a separate pipe holder which can be slid onto the pipe extension of a vacuum hose and a mount for the pipe holder assembled on the vacuum cleaner housing. The arrangement and the configuration of the vacuum hose rack are such that the vacuum hose pipe can be secured onto the side of the vacuum cleaner housing.

15 Claims, 7 Drawing Figures

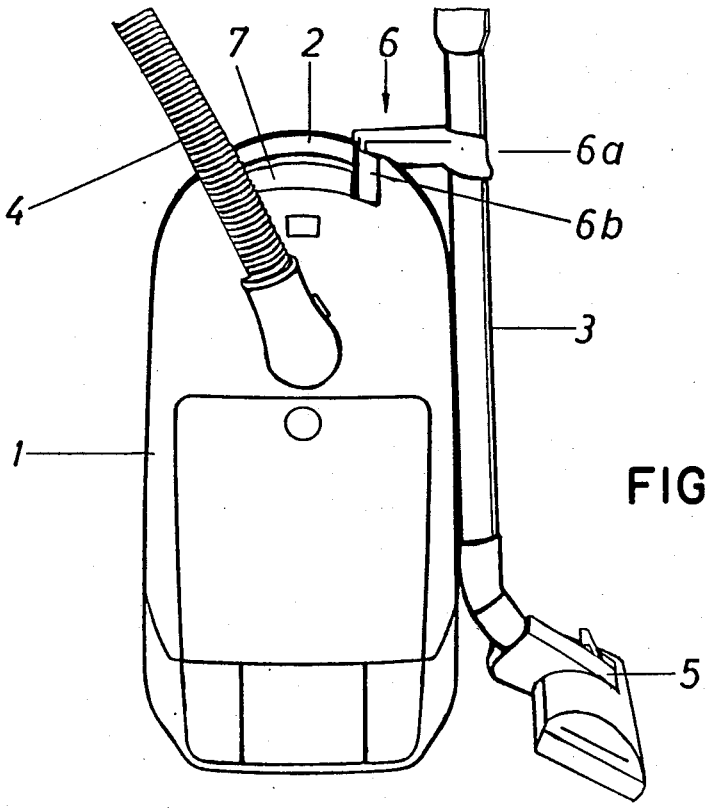
FIG. 1
FIG. 2
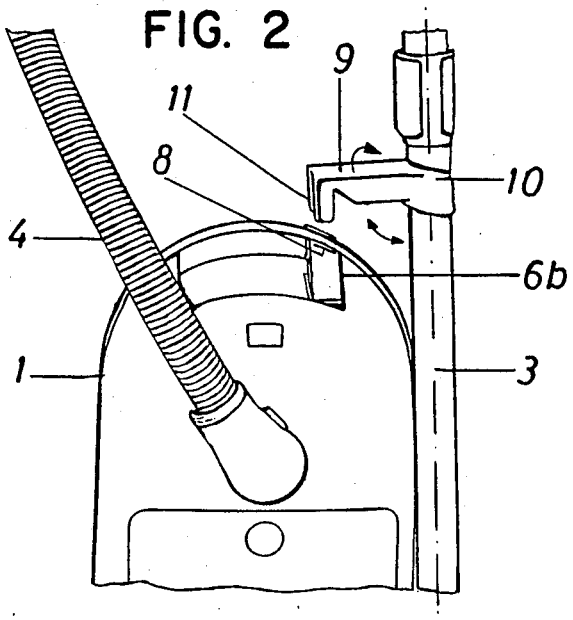
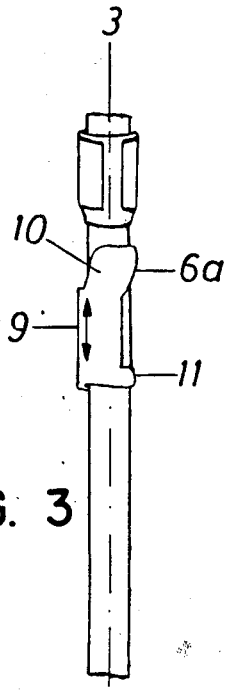
FIG. 3

VACUUM CLEANER HAVING A VACUUM HOSE HOLDER

The present invention relates to a vacuum cleaner, particularly a floor vacuum cleaner, having a handle grip and with a rack or holder designed to hold the vacuum hose pipe on the cleaner housing.

A vacuum cleaner of this type is known from German utility patent DE GM No. 17 35 261. In this known vacuum cleaner, provision is made for rack holders in the area of the vacuum cleaner handle grip, for the pipe extension of the vacuum hose to be secured essentially parallel to the longitudinal axis of the vacuum cleaner housing on the upper face of the housing. Such holding devices are formed as U-shaped elastic clamps. Holding devices so mounted on the upper face of the housing prevent—when the vacuum hose pipe is clamped on—the opening of the dust collector bin, if serviced from above, and/or impede the storage or removal of vacuuming accessories, such as crevice tools, vacuum brushes and the like, in or out of a tool compartment similarly mounted on the upper face of the cleaner housing. Beyond that, such known storage racks made of elastic clamps constitute a major source of hazard once the vacuum hose pipe is removed. As the vacuum cleaner is moved about, the projecting brackets of such spring clamps may easily come into contact with, and damage, furniture pieces. What is more, injury to the operator cannot be ruled out due to the sharp edges of the spring clips. Beyond that, with the vacuum hose pipe clamped onto the upper face of the vaccum cleaner housing, the vacuum cleaner itself requires greater storage space in the closet or the like.

The object of the present invention, therefore, is to provide a holder or rack suitable for vacuum cleaners which permits space-saving storage of the vacuum hose both in carrying, as in operating breaks, and in storing the vacuum cleaner in a closet or the like, without interfering with the handling of the appliance in terms of operation and storage of accessories.

The above object is accomplished in accordance with the present invention by providing a vacuum cleaner having a carrying handle with a vacuum hose pipe rack formed of a two part structure consisting of a pipe holder slidably mounted on the vacuum hose pipe and a mount on the cleaner housing for the pipe holder.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 1 is a front elevational view of a floor vacuum cleaner in the upright position, with the vacuum hose pipe assembled in a holding rack on the vacuum cleaner;

FIG. 2 is a detailed view of the vacuum cleaner housing of FIG. 1 wherein the vacuum hose pipe is detached from the vacuum cleaner;

FIG. 3 is a detailed view of part of the vacuum hose pipe with the segment of the pipe holder associated therewith;

Figure 4:
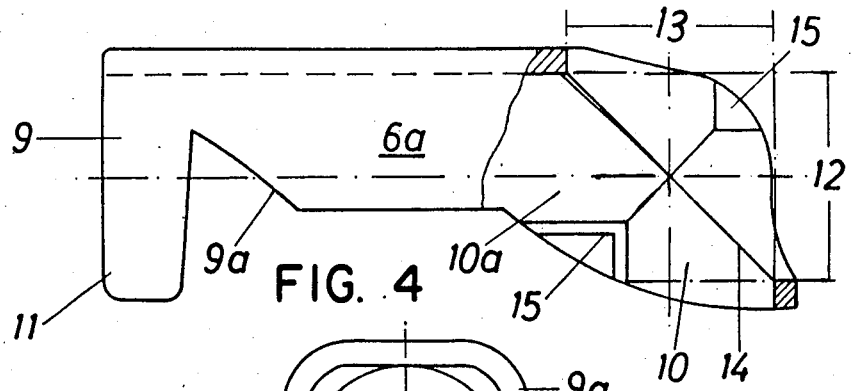
FIG. 4 is a front elevational view of the pipe holder without the vacuum hose pipe, partly in cross section.
Figure 5:
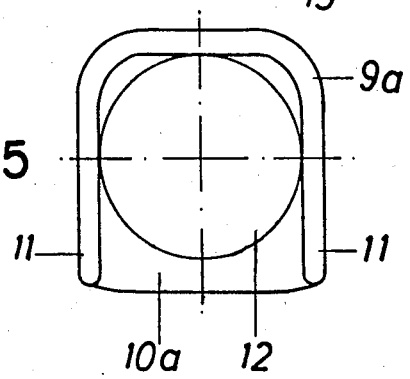
FIG. 5 is a left side view of the pipe holder shown in FIG. 4.
Figure 6:
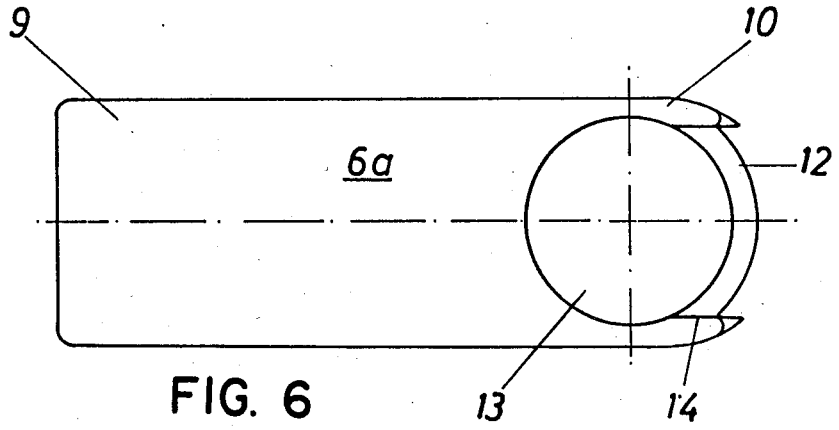
FIG. 6 is a top plan view of the pipe holder of FIG. 4.

Now turning to the drawings, there is shown in FIG. 1 a floor vacuum cleaner 1 outfitted with swivel casters, which features at its front end a grip handle 2 facilitating the transportation of the unit. In this sample embodiment, vacuum cleaner 1 is shown in its upright position, which might well be the position of the vacuum cleaner in transport, during operating breaks and in storage. In this position, vacuum hose pipe 3 of vacuum cleaner 1, which is connected in a conventional manner to a vacuum hose 4 and a floor nozzle 5, is assembled onto vacuum cleaner 1 with the aid of a holding rack 6. Provision is made for vacuum hose pipe 3 to be detachably stored on the side of the housing of vacuum cleaner 1, so that vacuum pipe 3 adjoins the housing laterally, when holding rack 6 is plugged in.

Holding rack 6 is formed of two parts, consisting of a vacuum hose pipe holder or rack **6*a* which may be slid onto pipe 3, which may for example be a telescoping pipe, and a mount 6*b* on the housing for pipe holder 6*a*. Pipe holder 6*a* (see FIGS. 2 to 6) may be freely pushed and rotated on vacuum pipe 3, in case its position is inappropriate, for example for attaching to mount 6*b***.

Figure 7:
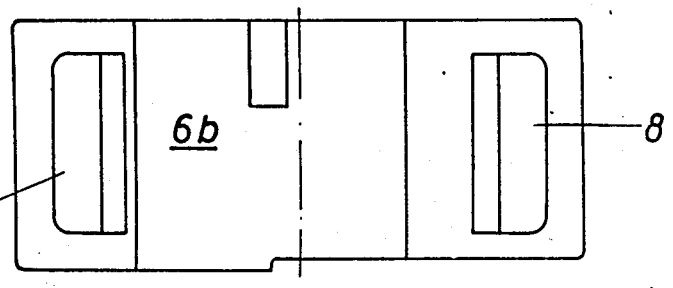
FIG. 7 is a view of the mount of the holding rack.

Pipe holder **6*a* is held on vacuum pipe 3 by contact friction, being made preferably of a viscous elastic plastic substance. The material for mount 6*b* (FIG. 7) is similarly plastic. Mount 6*b* for pipe holder 6*a* is secured inside cradle 7 for carrying handle 2 of vacuum cleaner 1. Mount 6*b* forms a fork-shaped enclosure over handle 2 and possesses at its upper side plug-in apertures 8 (see FIG. 7) where pipe holder 6*a* snaps in. It is especially advantageous to make provision for mount 6*b* in the area where handle 2 joins the vacuum cleaner housing, so as to minimize the length of pipe holder 6*a***.

Pipe holder **6*a*, detachably assembled onto mount 6*b* on the vacuum cleaner housing, consists of a clamping and fastening segment 9 and an adjoining pivoted element 10. The connection between pipe holder 6*a* and pipe 3 occurs by way of this pivoted part 10. The configuration of pipe holder 6*a* and its arrangement on vacuum pipe 3 is designed in such a way that clamping and fastening segment 9 is linked to pivoted element 10 (see FIG. 2) so as to swing out of its position of rest parallel to the vacuum pipe axis as seen in FIG. 3 into a position perpendicular to the longitudinal axis of vacuum pipe 3. It is advantageous for clamping and fastening segment 9 of vacuum pipe holder 6*a* to be constructed as a one-piece unit with pivoted element 10. To accomplish the swinging motions of pipe holder 6*a* on vacuum pipe 3, clamping and fastening segment 9 of pipe holder 6*a* consists of a pipe collet 9*a* shaped as a half-shell matching the diameter of vacuum pipe 3. Fasteners 11 are molded onto one end of pipe collet 9*a* and run perpendicular to the lengthwise axis of the collet for connecting pipe holder 6*a* with mount 6*b*** on the vacuum cleaner housing.

The other extremity of clamping and fastening segment 9 terminates in a pipe plug-in socket **10*a* bearing pivoted element 10 (see FIG. 4). This pipe plug-in socket itself constitutes the pivot and is provided with two plug-in apertures 12 and 13 (see FIGS. 4 to 6) for pipe 3. One of these plug-in apertures 12 is arranged as an extension of the lengthwise axis of clamping and fastening segment 9, while the other plug-in socket 13 impacts vertically onto first plug-in socket 12. Both these apertures have a common opening 14 in pivoted element 10 of pipe holder 6***a*, which permits on the one hand the pipe holder 6*a* to swing, and on the other hand limits the swinging motion. This common cutout 14 possesses molded detent cams 15, to arrest pipe holder 6*a* in its swing-out position, in which it either abuts pipe 3, as shown in FIG. 3, or is brought into its swung-out position necessary to snap into mount 6b, as shown in FIG. 2. Once vacuum pipe 3 is attached, fastening tracks 11 on pipe holder 6*a* fit tightly into the corresponding plug-in sockets 8 on mount 6*b* of holding rack 6 (see FIG. 7).

Pipe holder 6*a* and/or its clamping and fastening segment 9 is preferably designed in the shape of a carrying handle, so that pipe 3 with all accessories, such as floor nozzle 5 and vacuum hose 4 may be conveniently carried when pipe holder 6*a* is swung out. It may also be convenient to make fastener tracks 11 spring elastic so that attached pipe 3 may by itself spring out of mount 6*b* in case of excessive lateral compression or impact, thereby avoiding damage to holding rack 6.

While only a single embodiment of the present invention has been shown and described, it will be obvious that many changes and modifications may be made thereunto without departing from the spirit and scope of the invention.

What is claimed is:

1. In a vacuum cleaner, such as a floor vacuum cleaner having a housing, a carrying handle, a vacuum hose, a vacuum hose pipe, and a vacuum hose pipe rack mounted on the cleaner housing, the improvement comprising said vacuum hose pipe rack being formed in a two-part structure, consisting of a pipe holder adapted to slide onto the vacuum hose pipe and a mount on the vacuum cleaner housing for the pipe holder.

2. The vacuum cleaner according to claim 1, wherein the vacuum hose pipe is detachably stored on the side of the vacuum cleaner housing and said pipe holder is mounted on the vacuum hose pipe to be pivotable and height adjustable.

3. The vacuum cleaner according to claim 2, wherein the pipe holder connected to the mount on the vacuum cleaner housing so as to be detachable, comprises a clamping and fastening segment which permits in and out movement, and a pivoted element connected therewith.

4. The vacuum cleaner according to claim 3, wherein the pipe holder is connected to the vacuum hose pipe by said pivoted element, and the clamping and fastening segment is connected with the pivoted element so that it can be swung out from its position of rest parallel to the axis of the vacuum hose pipe into a position perpendicular to the longitudinal axis of the vacuum hose pipe.

5. The vacuum cleaner according to claim 4, wherein said clamping and fastening segment of the pipe holder is formed integrally as a one-piece unit with the pivoted element.

6. The vacuum cleaner according to claim 5, wherein said clamping and fastening segment comprises a vacuum hose pipe collet in a half-shell configuration matching the diameter of the vacuum hose pipe with fasteners molded onto a first end thereof perpendicular to the longitudinal axis of the collet which interconnect with the mount on the vacuum cleaner housing, and a plug-in pipe socket bearing the pivoted element at a second end of said clamping and fastening segment.

7. The vacuum cleaner according to claim 6, wherein said plug-in pipe socket is articulated and provided with two plug-in sockets for the vacuum hose pipe, one of said plug-in sockets being arranged as an extension of the longitudinal axis of the clamping and fastening segment and the other being perpendicular to the first plug-in socket and mounted inside a common aperture in the plug-in pipe socket accommodating both orifices.

8. The vacuum cleaner according to claim 7, wherein said common aperture is provided with molded detent cams.

9. The vacuum cleaner according to claim 8, wherein said pipe holder is held onto the vacuum hose pipe by means of contact friction.

10. The vacuum cleaner according to claim 9, wherein said pipe holder is constructed as a carrying handle for the vacuum hose pipe which mates with the vacuum hose and the floor nozzle of the vacuum cleaner.

11. The vacuum cleaner according to claim 5, wherein the fasteners on the clamping and fastening segment of the pipe holder are designed as elastic springs.

12. The vacuum cleaner according to claim 4, wherein the vacuum cleaner carrying handle is mounted at the front end of the vacuum cleaner and the vacuum hose pipe rack mount is provided at the point where the carrying handle joins the vacuum cleaner housing so that the swing-mounted clamping and fastening segment of the pipe handle spans the gap between the mount and the long side of the vacuum cleaner housing in such a way that the pipe holder connects laterally to the cleaner housing.

13. The vacuum cleaner according to claim 1, wherein the mount on the vacuum cleaner housing for the pipe holder is mounted in the cradle of the carrying handle of the vacuum cleaner.

14. The vacuum cleaner according to claim 13, wherein said mount forms a fork-shaped enclosure for the carrying handle of the vacuum cleaner and is provided on its upper side with plug-in sockets for the pipe holder.

15. The vacuum cleaner according to claim 1, wherein the vacuum hose pipe rack is made of plastic.

* * * * *